US006716309B2

(12) United States Patent
Chuang et al.

(10) Patent No.: US 6,716,309 B2
(45) Date of Patent: Apr. 6, 2004

(54) METHOD FOR THE APPLICATION OF VISCOUS COMPOSITIONS TO THE SURFACE OF A PAPER WEB AND PRODUCTS MADE THEREFROM

(75) Inventors: Strong Chuang, Appleton, WI (US); Keu-Chang Liu, Appleton, WI (US); Paul Beuther, Neenah, WI (US); Frank Druecke, Oshkosh, WI (US); Lee Garvey, Kaukauna, WI (US); Alan Chan, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 119 days.

(21) Appl. No.: 10/029,118

(22) Filed: Dec. 21, 2001

(65) Prior Publication Data

US 2003/0118847 A1 Jun. 26, 2003

(51) Int. Cl.[7] ..... D21H 19/02; D21H 23/50; B05D 3/00

(52) U.S. Cl. ..... 162/135; 162/158; 162/157.1; 162/164.1; 428/447; 428/452; 427/331; 427/361; 424/402

(58) Field of Search ..... 162/135–137, 162/158, 164.1, 157.1–157.2; 424/402; 428/447, 452, 156; 427/331, 361, 411, 356, 358, 395, 420, 424; 156/167, 178, 285; 264/171.21, 173.12, 555, 5

(56) References Cited

U.S. PATENT DOCUMENTS

| | | | | | |
|---|---|---|---|---|---|
| 3,795,571 | A | * | 3/1974 | Prentice | 442/346 |
| 3,811,957 | A | * | 5/1974 | Buntin | 429/143 |
| 3,849,241 | A | | 11/1974 | Butin et al. | |
| 3,959,421 | A | * | 5/1976 | Weber et al. | 264/6 |
| 3,970,417 | A | * | 7/1976 | Page | 425/72.2 |
| 4,618,689 | A | | 10/1986 | Traver et al. | |
| 4,699,988 | A | | 10/1987 | Traver et al. | |
| 4,753,843 | A | * | 6/1988 | Cook et al. | 442/333 |
| 4,911,956 | A | | 3/1990 | Gabryszewski et al. | |
| 4,950,545 | A | | 8/1990 | Walter et al. | |
| 5,047,485 | A | * | 9/1991 | DeNicola, Jr. | 525/387 |
| 5,059,282 | A | | 10/1991 | Ampulski et al. | |
| 5,075,068 | A | * | 12/1991 | Milligan et al. | 264/555 |
| 5,098,979 | A | | 3/1992 | O'Lenick, Jr. | |
| 5,164,046 | A | | 11/1992 | Ampulski et al. | |
| 5,215,626 | A | | 6/1993 | Ampulski et al. | |
| 5,227,242 | A | | 7/1993 | Walter et al. | |
| 5,237,035 | A | | 8/1993 | O'Lenick, Jr et al. | |
| 5,245,545 | A | | 9/1993 | Taylor | |
| 5,246,545 | A | | 9/1993 | Ampulski et al. | |
| 5,246,546 | A | | 9/1993 | Ampulski | |
| 5,385,643 | A | | 1/1995 | Ampulski | |
| 5,389,204 | A | | 2/1995 | Ampulski | |
| 5,525,345 | A | | 6/1996 | Warner et al. | |
| 5,538,595 | A | | 7/1996 | Trokhan et al. | |
| 5,573,637 | A | | 11/1996 | Ampulski et al. | |
| 5,601,871 | A | | 2/1997 | Krzysik et al. | |
| 5,614,293 | A | | 3/1997 | Krzysik et al. | |
| 5,623,043 | A | | 4/1997 | Fost et al. | |
| 5,624,676 | A | | 4/1997 | Mackey et al. | |
| 5,650,218 | A | | 7/1997 | Krzysik et al. | |
| 5,665,426 | A | | 9/1997 | Krzysik et al. | |
| 5,688,496 | A | | 11/1997 | Fost et al. | |
| 5,705,164 | A | | 1/1998 | Mackey et al. | |
| 5,707,434 | A | | 1/1998 | Halloran et al. | |
| 5,707,435 | A | | 1/1998 | Halloran | |
| 5,807,956 | A | | 9/1998 | Czech | |
| 5,814,188 | A | | 9/1998 | Vinson et al. | |
| 5,849,313 | A | | 12/1998 | Fost et al. | |
| 5,856,544 | A | | 1/1999 | Czech et al. | |
| 5,871,763 | A | | 2/1999 | Luu et al. | |
| 5,882,573 | A | | 3/1999 | Kwok et al. | |
| 5,885,697 | A | | 3/1999 | Krzysik et al. | |
| 5,902,540 | A | | 5/1999 | Kwok | |
| 5,925,469 | A | | 7/1999 | Gee | |
| 5,981,681 | A | | 11/1999 | Czech | |
| 5,990,377 | A | | 11/1999 | Chen et al. | |
| 6,033,723 | A | | 3/2000 | Kistler et al. | |
| 6,054,020 | A | | 4/2000 | Goulet et al. | |
| 6,077,375 | A | | 6/2000 | Kwok | |
| 6,090,885 | A | | 7/2000 | Kuo et al. | |
| 6,107,219 | A | * | 8/2000 | Joseph et al. | 442/361 |
| 6,120,784 | A | | 9/2000 | Snyder, Jr. | |
| 6,126,784 | A | | 10/2000 | Ficke et al. | |
| 6,183,814 | B1 | | 2/2001 | Nangeroni et al. | |
| 6,207,601 | B1 | * | 3/2001 | Maurer et al. | 442/333 |

(List continued on next page.)

FOREIGN PATENT DOCUMENTS

| | | | | | |
|---|---|---|---|---|---|
| EP | 0333212 | A2 | | 9/1989 | |
| EP | 1023863 | A1 | | 2/2000 | |
| EP | 1059032 | A1 | | 12/2000 | |
| WO | WO 9118682 | A1 | * | 12/1991 | B05D/1/02 |
| WO | 9704171 | | | 2/1997 | |
| WO | 9919081 | | | 4/1999 | |
| WO | WO 0068503 | A1 | | 11/2000 | |
| WO | 0071177 | A1 | | 11/2000 | |
| WO | 0128337 | | | 4/2001 | |
| WO | 0129315 | | | 4/2001 | |
| WO | 0248458 | A1 | | 6/2002 | |

OTHER PUBLICATIONS

Search Report—International Application No. PCT/US 02/376515 Apr. 01, 2003.

*Primary Examiner*—Josë A. Fortuna
(74) *Attorney, Agent, or Firm*—Dority & Manning, P.A.

(57) ABSTRACT

A method is disclosed for topical application of compositions containing a chemical additive onto a paper web. The present invention is also directed to paper products formed from the method. In general, the method includes the steps of extruding a composition containing a chemical additive through a melt blown die and then applying the composition to a moving paper web. In one embodiment, the chemical composition is extruded into fibers and applied to the paper web. The chemical composition can contain, for instance, various additives, such as a polysiloxane softener.

26 Claims, 4 Drawing Sheets

U.S. PATENT DOCUMENTS

| | | | | |
|---|---|---|---|---|
| 6,217,707 | B1 | | 4/2001 | Garvey et al. |
| 6,217,940 | B1 | | 4/2001 | Kuni |
| 6,231,719 | B1 | | 5/2001 | Garvey et al. |
| 6,238,682 | B1 | | 5/2001 | Klofta et al. |
| 6,306,408 | B1 | | 10/2001 | Eickhorn et al. |
| 6,322,604 | B1 | | 11/2001 | Midkiff |
| 6,355,772 | B1 | * | 3/2002 | Gruber et al. ..... 528/354 |
| 6,375,963 | B1 | * | 4/2002 | Repka et al. ..... 424/402 |
| 6,428,794 | B1 | * | 8/2002 | Klofta et al. ..... 424/401 |
| 6,428,799 | B1 | * | 8/2002 | Cen et al. ..... 424/402 |
| 6,432,270 | B1 | | 8/2002 | Liu et al. |
| 6,547,928 | B2 | | 4/2003 | Barnholtz et al. |

* cited by examiner

METHOD FOR THE APPLICATION OF VISCOUS COMPOSITIONS TO THE SURFACE OF A PAPER WEB AND PRODUCTS MADE THEREFROM

BACKGROUND OF THE INVENTION

Consumers use paper wiping products, such as facial tissues and bath tissues, for a wide variety of applications. Facial tissues are not only used for nose care but, in addition to other uses, can also be used as a general wiping product. Consequently, there are many different types of tissue products currently commercially available.

In some applications, tissue products are treated with polysiloxane lotions in order to increase the softness of the facial tissue. Adding silicone compositions to a facial tissue can impart improved softness to the tissue while maintaining the tissue's strength and while reducing the amount of lint produced by the tissue during use.

In the papermaking industry, various manufacturing techniques have been specifically designed to produce paper products which consumers find appealing. Manufacturers have employed various methods to apply chemical additives, such as silicone compositions, to the surface of a tissue web. Currently, one method of applying chemicals to the surface of a tissue web is the Rotogravure printing process. A Rotogravure printing process utilizes printing rollers to transfer chemicals onto a substrate. Chemical emulsions that are applied to webs using the Rotogravure printing process typically require the addition of water, surfactants, and/or solvents in order for the emulsions to be printed onto the substrate. Such additions are not only costly but also increase drying time and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical that is applied to a paper ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web.

SUMMARY OF THE INVENTION

In general, the present invention is directed to an improved process for applying compositions to paper webs, such as tissue webs, paper towels and wipers. The present invention is also directed to improved paper products made from the process.

For example, in one embodiment, the present invention is directed to a process for applying an additive to a paper web, such as a tissue web, that includes the step of extruding a viscous composition onto the paper web. The viscous composition has a viscosity sufficient for the composition to form fibers as the compositions is extruded onto the web. In general, any suitable extrusion device can be used to apply the composition to the web. In one embodiment, for instance, the composition is extruded through a melt blown die and attenuated prior to being applied to the web.

The composition can generally be any material that provides benefits to paper webs. For instance, the composition can be a topical preparation that improves the physical properties of the web, that provides the web with antibacterial properties, that provides the web with medicinal properties, or that provides any other type of wellness benefits to a user of the paper web. For instance, the composition can contain an anti-acne agent, an antimicrobial agent, an anti-fungal agent, an antiseptic, an antioxidant, a cosmetic astringent, a drug astringent, an aiological agent, an emollient, an external analgesic, a humectant, a moisturizing agent, a skin conditioning agent, a skin exfoliating agent, a sunscreen agent, and mixtures thereof. In one embodiment, the composition is a softener. The softener can be, for instance, a polysiloxane.

Of particular advantage, the process of the present invention is well-suited to applying relatively high viscous compositions to paper webs. For instance, the process can have a viscosity of at least 1000 cps, particularly 2000 cps and more particularly can have a viscosity of at least 3000 cps. Since the process is capable of handling high viscosity compositions, various chemical additives can be added directly to a paper web without having to dilute the additive with, for instance, water or any other type of dilution agent to form a solution or emulsion.

In fact, in one embodiment, a thickener can be added to the composition in order to increase the viscosity. The thickener can be, for instance, a polyethylene oxide. It should be understood, however, that any suitable or conventional thickener can also be used.

The amount of the composition that is applied to the paper web depends on the particular application. For example, when applying a softener to a tissue web, the softener can be added in an amount from about 0.1% to about 10% by weight and particularly from about 0.1% to about 5% by weight, based upon the weight of the web. As described above, in one embodiment, the composition is extruded through a melt blown die onto the paper web. The melt blown die can have a plurality of nozzles at a die tip. The nozzles can be arranged in one or more rows along the die tip. The fibers exiting the nozzles can have a diameter of from generally about 5 microns to about 100 microns or greater.

The process of the present invention provides great control over the amount of composition applied to the web and the placement of the composition on the web. It is believed that products made according to the process of the present invention have various unique characteristics. For instance, in one embodiment, a product made according to the present invention includes a paper web containing cellulosic fibers. The viscous composition containing a chemical additive is applied to at least one side of the paper web. In accordance with the present invention, the composition is present on the paper web in the form of fibers, such as continuous filaments.

In some applications, depending upon the composition that is applied to the paper web, a paper web treated in accordance with the present invention will have improved strength characteristics, particularly an improved cross direction wet:dry ratio. For instance, when treating a paper web in accordance with the present invention, the cross direction wet:dry ratio can increase by at least 25%, particularly at least 40%, and more particularly by at least 50%. For example, a tissue web treated with a hydrophobic composition, such as a polysiloxane, can have a wet:dry ratio of at least 0.45, particularly at least 0.48, and more particularly at least 0.52.

Various features and aspects of the present invention will be made apparent from the following detailed description.

BRIEF DESCRIPTION OF THE DRAWINGS

A full and enabling disclosure of this invention, is set forth in this specification. The following Figures illustrate the invention.

Figure 1:
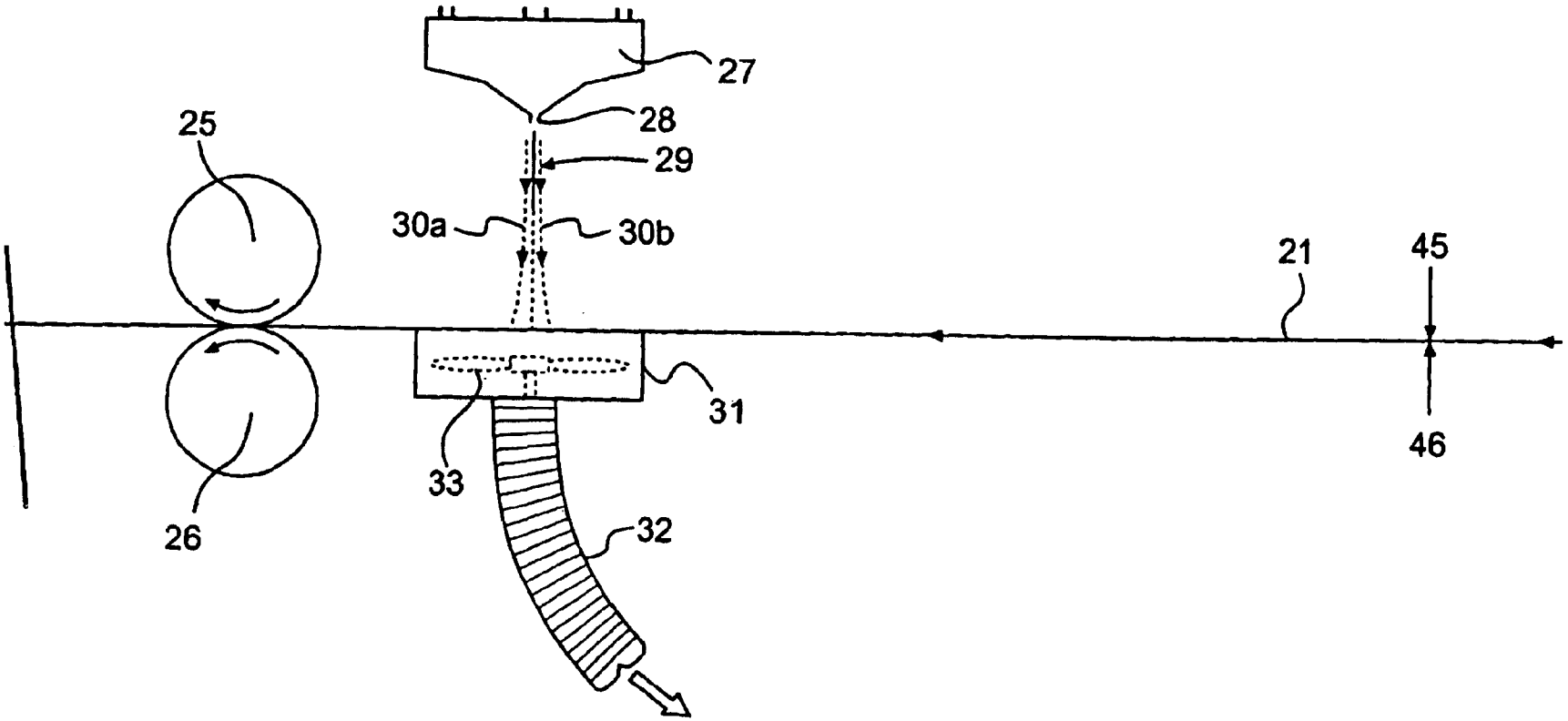
FIG. 1 is a schematic drawing showing application of a viscous composition through a melt blown die tip onto a paper web in accordance with the present invention.

Repeated use of reference characters in the present specification and drawings is intended to represent the same or analogous features of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to applying viscous chemical compositions through a melt blown die tip on to a paper web, such as a tissue web. It has been found by the present inventors that when compared with the Rotogravure printing process and the spray atomizing process, the melt blown process is more efficient.

For example, in comparison to the Rotogravure printing process, the process of the present invention for applying compositions to paper webs can be simpler and less complex. The process of the present invention also provides more flexibility with respect to operation parameters. For instance, it has been found that the process of the present invention provides better controls over flow rates and add on levels of the compositions being applied to the paper webs. In some applications, the process of the present invention may also allow the compositions to be applied to the paper webs at higher speeds in comparison to many Rotogravure printing processes.

In comparison to spray atomization processes, the process of the present invention can provide greater control over application rates and can apply compositions to paper webs more uniformly. The process of the present invention also can better prevent against over application of the composition and can provide better controls over placement of the composition onto the web.

Another advantage to the process of the present invention is that the process is well suited to applying relatively high viscous chemical additives to paper webs. Thus, it has been discovered that additives can be applied to paper webs without first combining the additives with dilution agents, solvents, surfactants, preservatives, antifoamers, and the like. As a result, the process of the present invention can be more economical and less complex than many conventional application systems.

In one embodiment, a composition containing a chemical additive in accordance with the present invention can be applied to a paper web in the form of fibers, such as, for instance, in the form or continuous fibers. Specifically, it has been discovered that under certain circumstances, compositions applied in accordance with the present invention will fiberize when extruded through the melt blown die tip. The ability to fiberize the compositions provides various advantages. For example, when formed into fibers, the composition is easily captured by the paper web. The fibers can also be placed on the web in specific locations. Further, when desired, the fibers will not penetrate through the entire thickness of the web, but instead, will remain on the surface of the web, where the chemical additives are intended to provide benefits to the consumer.

Another advantage of the present invention is that for some applications, a lesser amount of the chemical additive can be applied to the web than what was necessary in many rotogravure processes while still obtaining an equivalent or better result. In particular, it is believed that since the chemical additive can be applied in a relatively viscous form without having to be formed into an emulsion or a solution and because the chemical additive can be applied as fibers uniformly over the surface of a web, it is believed that the same or better results can be obtained without having to apply as much of the chemical additive as was utilized in many prior art processes. For example, a softener can be applied to a web in a lesser amount while still obtaining the same softening effect in comparison to Rotogravure processes and spray processes. Further, since less of the chemical additive is needed, additional cost savings are realized.

It has also been discovered that in some applications treating paper webs in accordance with the present invention can significantly increase the wet strength of the webs. For instance, when applying certain compositions such as hydrophobic compositions, it has been discovered that the treated paper web will have an improved cross direction wet:dry ratio. As used herein, the "wet:dry ratio" is the ratio of the wet tensile strength divided by the dry tensile strength. For paper webs treated in accordance with the present invention, the cross direction wet:dry ratio can increase by at least 25% particularly by at least 40%, and more particularly by at least 50%.

For instance, tissue webs treated in accordance with the present invention with a hydrophobic composition, such as a polysiloxane, can have a cross direction wet:dry ratio of at least 0.45, particularly at least 0.48, and more particularly at least 0.50. By applying a hydrophobic composition to the surface of a tissue web in the form of continuous filaments, a network of non-wettable tissue is formed that can provide significant strength when the tissue is wet, but still allow for excellent absorbency due to a large amount of uncoated tissue between the filaments.

Possible ingredients or chemical additives that can be applied to paper webs in accordance with the present invention include, without limitation, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. The above chemical additives can be applied alone or in combination with other additives in accordance with the present invention.

In one embodiment of the present invention, the process is directed to applying a softener to a tissue web. The softener can be, for instance, a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries, Y-14128, Y-14344, Y-14461 and FTS-226 of the Witco Corporation, and Dow Corning 8620, Dow Corning 2-8182 and Dow Corning 2-8194 of the Dow Corning Corporation.

In the past, polysiloxanes were typically combined with water and surfactants, such as nonionic ethoxylated alcohols, to form emulsions and applied to tissue webs. Since the process of the present invention can accommodate higher viscosities, however, the polysiloxanes can be added directly to a tissue web or to another paper product without having to be combined with water, a surfactant or any other dilution agent. For example, a neat composition, such as a neat polysiloxane can be applied to a web in accordance with the present invention.

Referring to FIG. 1, one embodiment of a process in accordance with the present invention is illustrated. As shown, a tissue web 21 moves from the right to the left and is comprised of a first side 45 that faces upwards and a second side 46 that faces downward. The tissue web 21 receives a viscous composition stream 29 upon its first side 45.

In general, the composition stream 29 is applied to the web 21 after the web has been formed. The composition can be applied to the web, for instance, after the web has been formed and prior to being wound. Alternatively, the composition can be applied in a post treatment process in a rewinder system. As illustrated in FIG. 1, the web 21 can be calendared, using calendar rolls 25 and 26 subsequent to application of the composition. Alternatively, the web can be calendared and the composition can be applied to the web thereafter. The calendar rolls can provide a smooth surface for making the product feel softer to a consumer.

As shown in the figures, a composition containing a chemical additive is extruded to form a composition stream 29 that is directed onto the web 21. In general, any suitable extrusion device can be used in accordance with the present invention. In one embodiment, for instance, the extruder includes a melt blown die 27. A melt blown die is an extruder that includes a plurality of fine, usually circular, square or rectangular die capillaries or nozzles that can be used to form fibers. In one embodiment, a melt blown die can include converging high velocity gas (e.g. air) streams which can be used to attenuate the fibers exiting the nozzles. One example of a melt blown die is disclosed, for instance, in U.S. Pat. No. 3,849,241 to Butin, et al which is incorporated herein by reference.

As shown in FIG. 1, melt blown die 27 extrudes the viscous composition stream 29 from die tip 28. As illustrated, the meltblown die can be placed in association with an air curtain 30*a–b*. The air curtain 30*a–b* may completely surround the extruded composition stream 29, while in other applications the air curtain 30*a–b* may only partially surround the composition stream 29. When present, the air curtain can facilitate application of the composition to the paper web, can assist in forming fibers from the composition being extruded and/or can attenuate any fibers that are being formed. Depending upon the particular application, the air curtain can be at ambient temperature or can be heated.

An exhaust fan 31 is located generally below the tissue web 21. The exhaust fan 31 is provided to improve air flow and to employ a pneumatic force to pull the composition stream 29 down on to the first side 45 of the tissue web 21. The exhaust fan 31 serves to remove from the immediate vicinity airborne particles or other debris through an exhaust duct 32. The exhaust fan 31 operates by pulling air using the rotating propeller 33 shown in dotted phantom in FIG. 1.

Figure 2:
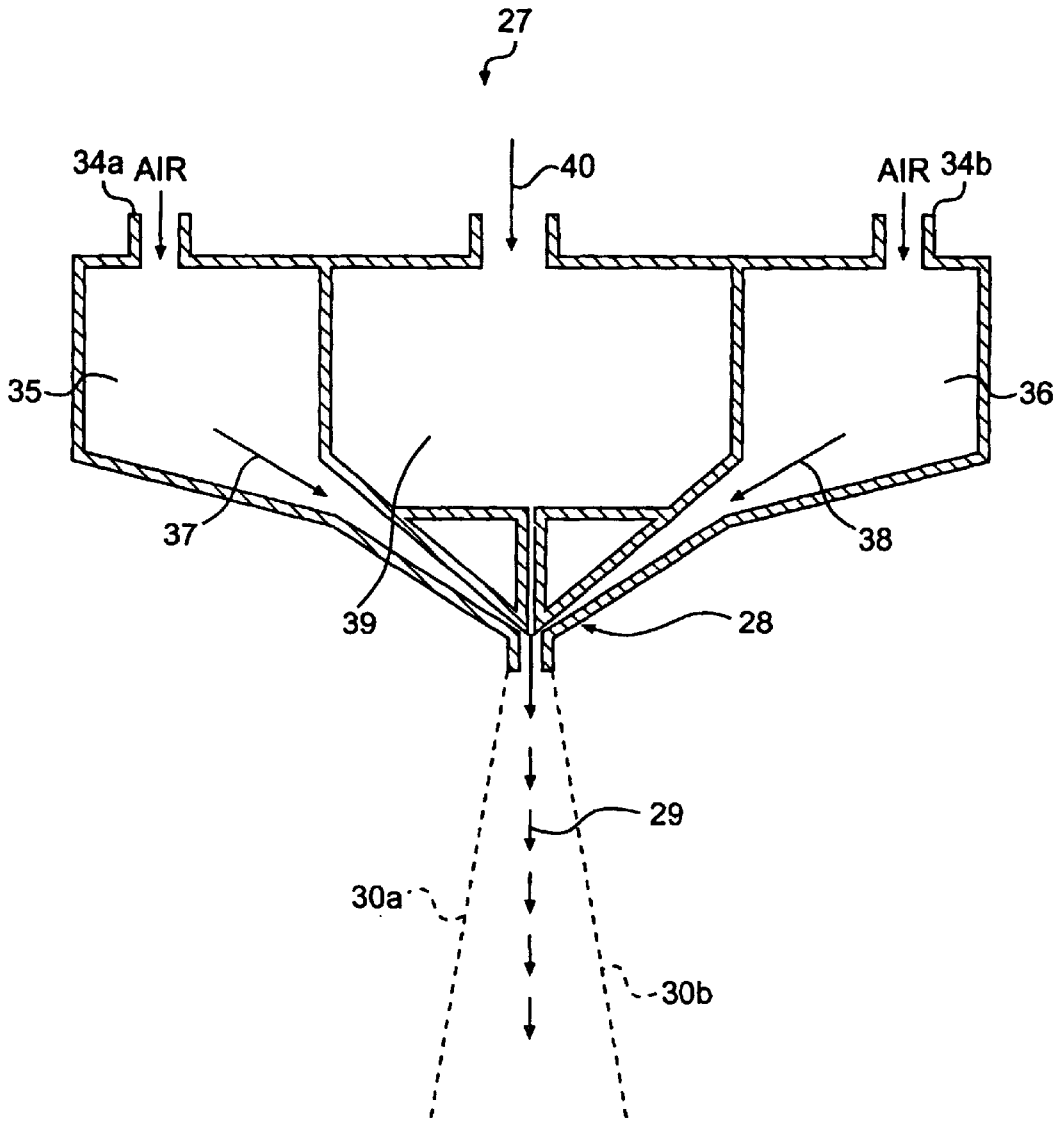
FIG. 2 is a side view of one embodiment of a melt blown die that can be used in accordance with the present invention.

In FIG. 2, a more detailed view of the melt blown die 27 is shown in which air intake 34*a–b* brings air into the melt blown die 27. Air travels into air duct 35 and air duct 36, respectively, from air intake 34*a* and 34*b*. The air proceeds along air pathway 37 and air pathway 38, respectively, to a point near the center of die tip 28 at which the air is combined with viscous composition 40 containing the desired chemical additives that emerges from a reservoir 39 to die tip 28. Then, the composition travels downward as viscous composition stream 29, shielded by air curtain 30*a–b*.

Figure 3:
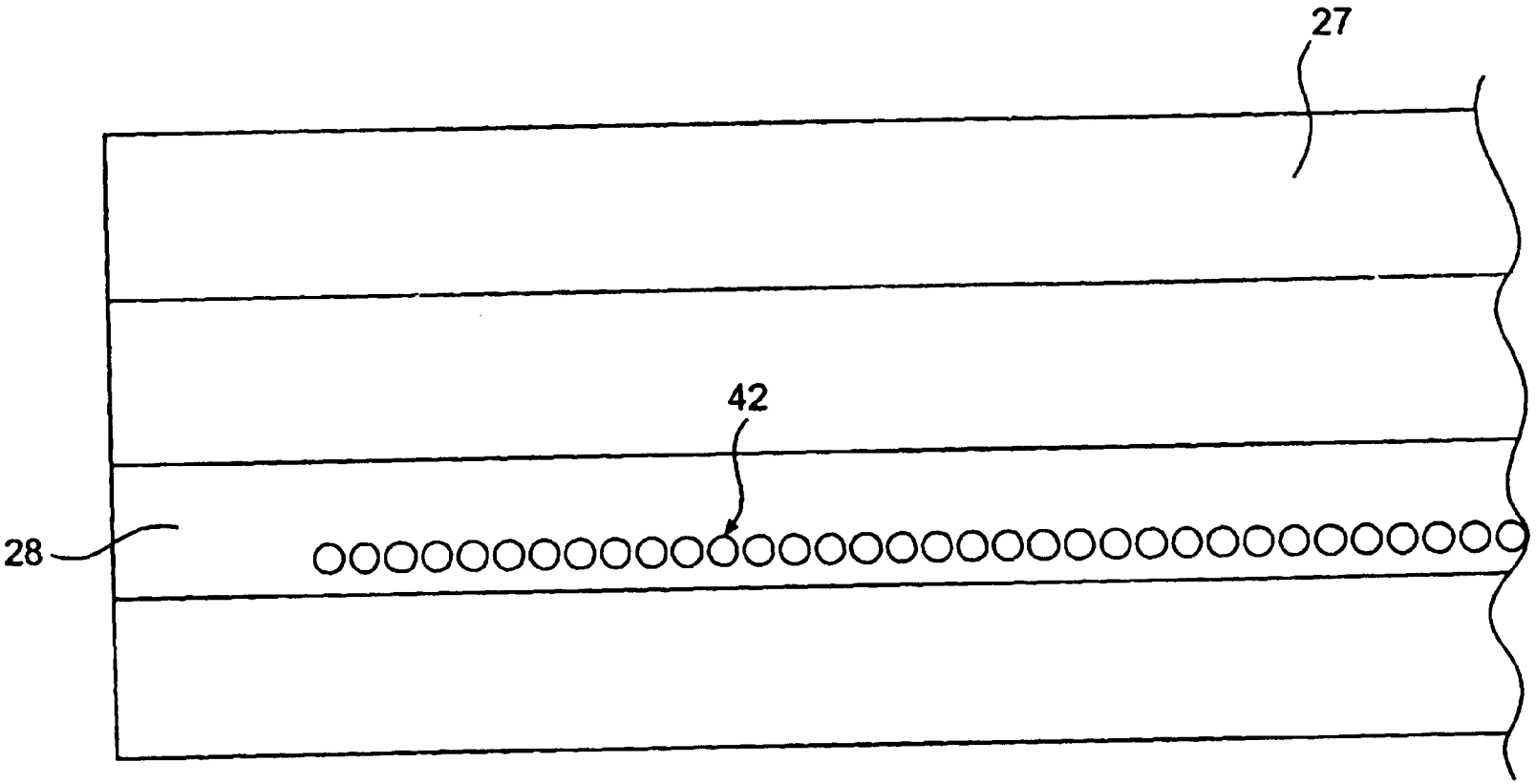
FIG. 3 is a bottom view of a portion of the melt blown die illustrated in FIG. 2 showing, in this embodiment, a row of nozzles through which compositions are extruded.

FIG. 3 shows a bottom view of the melt blown die 27 as it would appear looking upwards from the tissue web 21 (as shown in FIG. 1) along the path of the composition stream 29 to the point at which it emerges from die tip 28. In one embodiment, the melt blown die 27 is comprised of orifices 42 (several of which are shown in FIG. 3), and such orifices 42 may be provided in a single row as shown in FIG. 3. In other embodiments, there could be only a few scattered orifices 42; or perhaps, instead, a number of rows or even a series of channels could be used to release the composition stream 29 from melt blown die 27. In some cases, a combination of channels and orifices 42 could be used. In other cases (not shown), multiple rows of openings could be provided, and there is no limit to the different geometrical arrangement and patterns that could be provided to the melt blown die 27 for extruding a composition stream 29 within the scope of the invention.

In one specific embodiment of the invention, a pressurized tank (not shown) transfers a gas, such as air, to the melt blown die 27 for forcing the composition through the die tip. Composition 40 is forced through the melt blown die 27 and extruded through, for instance, nozzles spaced along the length of the die tip. In general, the size of the nozzles and the amount of the holes located on the melt blown die tip can vary depending upon the particular application.

For example, the nozzles can have a diameter from about 10 mils to about 50 mils, and particularly from about 14 mils to about 25 mils. The nozzles can be spaced along the die tip in an amount from about 3 nozzles per inch to about 50 nozzles per inch, and particularly from about 5 nozzles per inch to about 30 nozzles per inch. For example, in one embodiment, a die tip can be used that has approximately 17 nozzles per inch, and wherein each nozzle has a diameter of about 14 mils.

Two streams of pressurized air converge on either side of the composition stream 29 after it exits the melt blown die 27. The resulting air pattern disrupts the laminar flow of the composition stream 29 and attenuates the fibers being formed as they are directed onto the surface of the web.

In general, the fibers that can be formed according to the present invention include discontinuous fibers and continuous fibers. The fibers can have various diameters depending upon the particular application. For instance, the diameter of the fibers can vary from about 5 microns to about 100 microns. In one embodiment, continuous fibers are formed having a diameter of about 25 microns.

The flow rate of the composition 40 may be, for instance, from about 2 grams/minute/inch to about 9 grams/minute/inch in one embodiment. The flow rate will depend, however, on the composition and chemical additive being applied to the paper web, on the speed of the moving paper web, and on various other factors. In general, the total add on rate of the composition (including add on to both sides of the web if both sides are treated) can be up to about 10% based upon the weight of the paper web. When applying a softener to the paper web, for instance, the add on rate can be from about 0.1% to about 5% by weight, and particularly from about 0.5% to about 3% by weight of the paper web.

The viscosity of the composition can also vary depending upon the particular circumstances. When it is desired to produce fibers through the melt blown die, the viscosity of the composition should be relatively high. For instance, the viscosity of the composition can be at least 1000 cps, particularly greater than about 2000 cps, and more particularly greater than about 3000 cps. For example, the viscosity of the composition can be from about 1000 to about 50,000 cps and particularly from about 2000 to about 10,000 cps.

As stated above, the purpose for air pressure or air curtain 30*a–b* on either side of the composition stream 29 (in selected embodiments of the invention) is to assist in the formation of fibers, to attenuate the fibers, and to direct the fibers onto the tissue web. Various air pressures may be used.

The temperature of the composition as it is applied to a paper web in accordance with the present invention can vary depending upon the particular application. For instance, in some applications, the composition can be applied at ambient temperatures. In other applications, however, the composition can be heated prior to or during extrusion. The composition can be heated, for instance, in order to adjust the viscosity of the composition. The composition can be heated by a pre-heater prior to entering the melt blown die or, alternatively, can be heated within the melt blown die itself using, for instance, an electrical resistance heater.

In one embodiment, the composition containing the chemical additive can be a solid at ambient temperatures (from about 20° C. to about 23° C.). In this embodiment, the composition can be heated an amount sufficient to create a flowable liquid that can be extruded through the meltblown die. For example, the composition can be heated an amount sufficient to allow the composition to be extruded through the meltblown die and form fibers. Once formed, the fibers are then applied to a web in accordance with the present invention. The composition can resolidify upon cooling.

Examples of additives that may need to be heated prior to being deposited on a paper web include compositions containing behenyl alcohol. Other compositions that may need to be heated include compositions that contain a wax, that contain any type of polymer that is a solid at ambient temperatures, and/or that contain a silicone. One particular embodiment of a composition that may need to be heated in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above composition is well suited for use as a lotion when applied to a cellulosic web.

The above compositions can be heated to a temperature, for instance, from about 75° C. to about 150° C.

In FIG. 1, the composition containing the chemical additive is applied to the top surface of a paper web. It should be understood, however, that the composition can be applied to both sides of the paper web or, alternatively, can be applied between a pair of adjacent layers. As described above, the composition containing the additives of the present invention is generally applied after the web is formed. The composition can be applied while the web is dry or while the web is wet.

Figure 4:
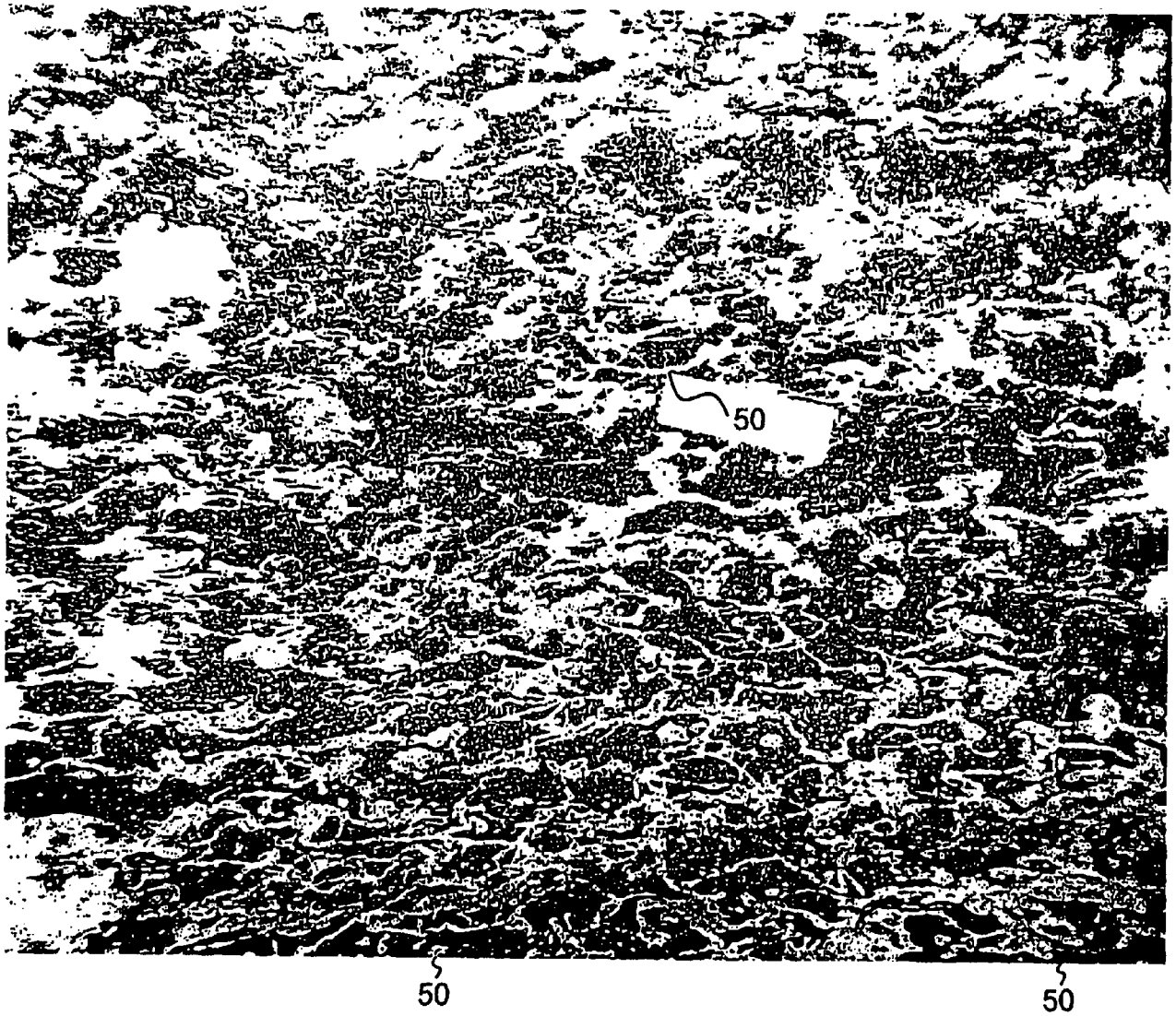
FIG. 4 is a plan view of one embodiment of a paper web made in accordance with the present invention.

Referring to FIG. 4, one embodiment of a paper web 21 treated in accordance with the present invention is shown. In this figure, the paper web is illustrated in a dark color to show the presence of fibers or filaments 50 appearing on the surface of the web. As shown, the filaments 50 intersect at various points and are randomly dispersed over the surface of the web. It is believed that the filaments 50 form a network on the surface of the web that increases the strength, particularly the wet strength of the web.

In the embodiment shown in FIG. 4, the filaments 50 only cover a portion of the surface area of the web 21. In this regard, the composition used to form the filaments can be applied to the web so as to cover from about 20% to about 80% of the surface of the web, and particularly from about 30% to about 60% of the surface area of the web. By leaving untreated areas on the web, the web remains easily wettable. In other applications, however, it should be understood that the viscous composition can be extruded onto the web so as to cover the entire surface area.

The process of the present invention can be used to apply compositions and chemical additives to numerous and various different types of products. For most applications, however, the present invention is directed to applying chemical additives to paper products, particularly wiping products. Such products include facial tissues and bath tissues that have a basis weight of less than about 60 gsm, and particularly from about 20 gsm to about 60 gsm, and more particularly from about 25 gsm to about 45 gsm. The tissue web can be made exclusively of pulp fibers or, alternatively, can contain pulp fibers mixed with other fibers.

Besides tissue products, however, the process of the present invention can also be applied to paper towels and industrial wipers. Such products can have a basis weight of up to about 200 gsm and particularly up to about 150 gsm. Such products can be made from pulp fibers alone or in combination with other fibers, such as synthetic fibers.

In one embodiment, various additives can be added to the composition in order to adjust the viscosity of the composition. For instance, in one embodiment, a thickener can be applied to the composition in order to increase its viscosity. In general, any suitable thickener can be used in accordance with the present invention. For example, in one embodiment, polyethylene oxide can be combined with the composition to increase the viscosity. For example, polyethylene oxide can be combined with a polysiloxane softener to adjust the viscosity of the composition to ensure that the composition will produce fibers when extruded through the melt blown die.

EXAMPLE

The following example was performed in order to illustrate the improvement in strength properties that are obtained through the process of the present invention.

In this example, two ply tissue webs were prepared, and treated with an amino functional hydrophobic silicone softening agent under simulated commercial conditions. In particular, the treated tissue webs were treated while the webs were moving at a speed of 3000 feet per minute.

Each ply of the two ply tissue webs were made from a layered fiber furnish. Specifically, each ply contained a first layer of eucalyptus fibers and a second layer of softwood fibers. The eucalyptus fibers comprised 65% by weight of the ply, while the softwood fibers comprised 35% by weight of the ply. The two plies were attached together such that the eucalyptus fibers formed the outside surfaces of the tissue web.

As described above, an amino functional hydrophobic silicone softening agent was applied to the treated tissue webs. An equivalent tissue web was also left untreated for comparison. The silicone softening agent was product number Y-14128 obtained from the Witco Corporation. The silicone composition was applied to each side of the treated tissue webs using a meltblown die. The silicone composition was applied to yield a total add-on level from about 0.75% to about 1.25% by weight based on the weight of the tissue.

The meltblown die included 17 orifices per inch and was operated at an air pressure of 20 psi and 30 psi in different sample runs. It was observed during operation of the meltblown die that by increasing the air pressure of the meltblown die, thinner fibers were produced having more cross directional orientation.

After the tissue webs had been treated, the samples were examined and compared for various physical characteristics. Basis weights were determined for the various tissue webs on both a bone dry basis and a conditioned basis wherein the tissue web had been conditioned under TAPPI conditions (50% RH, 22.7° C.). Caliper and bulk of the tissue webs were also determined. Caliper and bulk of the web were determined by use of an EMVECO 200A Tissue Caliper Tester at a load of about 2.00 kPa over an area of about 2500 $mm^2$.

Tensile strengths were measured using an Instron tensile tester using a 3-inch jaw width, a jaw span of 4 inches and a cross head speed of 10 inches per minute after maintaining the sample under TAPPI conditions (50% RH, 22.7° C.) for 4 hours before testing. Wet strength was measured in the same manner as dry strength except that the tissue sample was folded without creasing about the midline of the sample, held at the ends, and dipped in deionized water for about 0.5 seconds at a depth of about 0.5 centimeters to wet the central portion of the sample. The wetted region was touched for about 1 second against an absorbent towel to remove excess drops of fluid, and the sample was unfolded and set into the tensile tester jaws and immediately tested. The cross direction wet:dry ratio was determined and is reported in the table below. As stated above, the wet:dry ratio is the ratio of the wet tensile strength divided by the dry tensile strength. The wet:dry ratio was determined using the wet and dry cross direction tensile strengths.

Various other results obtained from the above tensile testing method are also reported in the table below. Machine direction (MD) and cross direction (CD) tensile strengths for the tissue webs are reported in units of grams of loading to breakage per 3-inches sample width. The ratio of MD tensile strength to CD tensile strength for the dry tissue webs is also reported. Percent stretch of the dry tissue web at peak load was determined, as was total energy absorbed (TEA) which has units of centimeters-grams of force per square centimeter. Geometric mean tensile (GMT) strength is defined as the square root of the product of the CD tensile strength and the MD tensile strength. The modulus of the tissue web is defined as the slope of the tensile strength curve measured over a specific load range during the tensile test, for example between about 70 grams and 150 grams of loading. The slope was determined in both the cross direction and the machine direction for the dry tissue webs. The geometric mean modulus (GMM) is reported as the square root of the product of the CD modulus and the MD modulus.

The Hercules Size Test is a measure of absorbency, with lower numbers indicating a more absorbent product. The test measures the time required for the reflectance of a tissue web to decrease to a predetermined value as a dye solution penetrates through the tissue web. Results are reported in seconds, with values less than about 5 indicating a reasonably absorbent product.

Void volume of the resultant sheet was determined according to the following void-volume test. First, the sheet was saturated with a non-polar liquid and the volume of liquid absorbed was measured. The volume of liquid absorbed is equivalent to the void volume within the sheet structure. The void volume is expressed as grams of liquid absorbed per gram of fiber in the sheet.

The test includes the following steps. For each sample to be tested, sheets are selected and a 1 inch×1 inch square (1 inch in the machine direction and 1 inch in the cross machine direction) is cut out. The dry weight of each test specimen is weighed and recorded to the nearest 0.0001 gram.

The specimen is placed in a dish containing POROFIL™ pore wetting liquid of sufficient depth and quantity to allow the specimen to float freely following absorption of the liquid. (POROFIL™ liquid, having a specific gravity of 1.875 grams per cubic centimeter, available from Coulter Electronics Ltd., Northwell Drive, Luton, Beds., England; Part No. 9902458.) After 10 seconds, the specimen is held at the very edge (1–2 millimeters in) of one corner with tweezers and removed from the liquid. The specimen is held with that corner uppermost and excess liquid is allowed to drip for 30 seconds. The lower corner of the specimen is lightly dabbed (less than ½ second contact) with #4 filter paper (Whatman Ltd., Maidstone, England) in order to remove any excess of the last partial drop. The specimen is immediately weighed, within 10 seconds. The weight is recorded to the nearest 0.0001 gram. The void volume for each specimen, expressed as grams of POROFIL per gram of fiber, is calculated as follows:

$$\text{Void volume}=[(W_2-W_1)/W_1],$$

wherein $W_1$=dry weight of the specimen, in grams, and $W_2$=wet weight of the specimen, in grams.

Fuzziness, Grittiness, Silkiness, and Stiffness values were obtained through a Sensory Profile Panel testing method. A group of 12 trained panelists were given a series of tissue prototypes, one sample at a time. For each sample, the panelists rate the tissue for fuzziness (high values are preferred), grittiness (low values are preferred), silkiness (high values are preferred), and stiffness (low values are preferred) on a scale of 1 (low) to 16 (high) in a sequential, monadic fashion. Results are reported as an average of panel rankings.

The results are described below in Table 1.

TABLE 1

| | Untreated | Y-14128 at 20 psi | Y-14128 at 30 psi |
|---|---|---|---|
| Basis Weight ($g/m^2$) (conditioned) | 27.63 | 28.52 | 28.46 |
| Basis Weight ($g/m^2$) (bone dry) | 25.77 | 26.74 | 26.61 |
| Caliper ($\mu$m) | 166 | 178 | 172 |
| Bulk ($cm^3/g$) | 6.01 | 6.24 | 6.04 |
| MD Tensile - Dry (g/3 in) | 1012 | 897 | 866 |
| CD Tensile - Dry (g/3 in) | 410 | 366 | 364 |
| GMT - Dry (g/3 in) | 644 | 573 | 561 |
| MD/CD ratio - Dry | 2.47 | 2.45 | 2.38 |
| CD Tensile - Wet g/3 in) | 143 | 176 | 189 |
| Wet:Dry Ratio | 0.35 | 0.48 | 0.52 |
| MD Stretch - Dry (%) | 12.9 | 13.6 | 14.6 |
| CD Stretch - Dry (%) | 5.9 | 5.2 | 4.9 |
| MD TEA - Dry (g-cm/$cm^2$) | 10.44 | 9.85 | 10.3 |
| CD TEA - Dry (g-cm/$cm^2$) | 2.73 | 2.37 | 2.18 |
| MD Slope - Dry (kg) | 9.86 | 8.18 | 7.63 |
| CD Slope - Dry (kg) | 8.97 | 9.41 | 10.24 |
| GMM - Dry (kg) | 9.40 | 8.77 | 8.84 |
| Hercules Size Test (sec.) | 0.6 | 1.7 | 2.4 |
| Void Volume (g fluid/g fiber) | 7.83 | 7.88 | 7.75 |
| Fuzziness | 6.61 | 6.77 | 6.72 |
| Grittiness | 1.44 | 1.40 | 1.32 |
| Stiffness | 3.99 | 3.26 | 3.34 |
| Silkiness | 9.73 | 9.75 | 9.85 |

As shown above, the cross direction wet:dry ratio significantly improved after the tissue web had been treated in accordance with the present invention. This improvement is due not only to the increase in the wet strengths of the treated tissue webs, but also due to the slight decrease in dry strengths upon treatment of the webs. Generally, lower dry strength products are softer products. Improved softness is illustrated by the fact that the treated webs are perceived as silkier, fuzzier, less gritty and less stiff than are the untreated webs. The treated webs also maintain good absorbency with very little change in void volume.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed:

1. A paper product comprising:

a paper web containing cellulosic fibers; and a topical composition applied to at least one side of the paper web, the composition comprising a chemical additive, the composition being applied to the paper web in the form of fibers, and wherein the composition is applied to the paper web in an amount sufficient to increase the cross direction wet:dry ratio by at least 25%.

2. A paper product as defined in claim 1, wherein the composition is applied to the paper web in an amount sufficient to increase the wet:dry ratio by at least 40%.

3. A paper product as defined in claim 1, wherein the paper web comprises a tissue web having a basis weight of less than about 50 gsm, the tissue web after being treated with the composition having a wet:dry ratio of at least 0.45.

4. A paper product as defined in claim 1, wherein the paper web comprises a tissue web having a basis weight of less than about 50 gsm, the tissue web after being treated with the composition having a wet:dry ratio of at least 0.50.

5. A paper product as defined in claim 1, wherein the fibers comprise continuous filaments.

6. A paper product as defined in claim 5, wherein filaments have a diameter of from about 5 microns to about 100 microns.

7. A paper product as defined in claim 1, wherein the composition is applied to the paper web in an amount up to about 5% by weight of the web.

8. A paper product as defined in claim 1, wherein the composition is applied to both sides of the web.

9. A paper product as defined in claim 1, wherein the composition comprises a polysiloxane.

10. A paper product as defined in claim 1, wherein the treated paper product is hydrophobic.

11. A paper product as defined in claim 1, wherein the composition consists essentially of a polysiloxane.

12. A paper product as defined in claim 1, wherein the topical composition is a solid at ambient temperatures.

13. A paper product as defined in claim 1, wherein the composition is applied to the paper web in an amount sufficient to increase the wet strength of the paper web and to decrease the dry strength of the paper web.

14. A paper product comprising:

a paper web comprising cellulosic fibers; and a topical viscous composition applied to at least one side of said paper web, said viscous composition comprising a chemical additive, said viscous composition being present on said paper web in the form of attenuated fibers.

15. A paper product as defined in claim 14, wherein said fibers comprise continuous filaments.

16. A paper product as defined in claim 14, wherein said chemical additive comprises a softener.

17. A paper product as defined in claim 14, wherein said viscous composition consists essentially a softener.

18. A paper product as defined in claim 17, wherein said softener comprises a polysiloxane.

19. A paper product as defined in claim 14, wherein said softener comprises a polysiloxane.

20. A paper product as defined in claim 14, wherein said viscous composition further comprises a thickener.

21. A paper product as defined in claim 20, wherein said thickener comprises a polyethylene oxide.

22. A paper product as defined in claim 14, wherein the viscous composition is added to the paper web in an amount sufficient to increase the cross direction wet:dry ratio by at least 25%.

23. A paper product as defined in claim 14, wherein the viscous composition is added to the paper web in an amount sufficient to increase the cross direction wet:dry ratio by at least 40%.

24. A paper product as defined in claim 14, wherein the paper web comprises a tissue web having a basis weight of less than about 50 gsm and wherein the viscous composition comprises a polysiloxane, said tissue web after being treated with the composition having a wet:dry ratio of at least 0.45.

25. A paper product as defined in claim 14, wherein the paper web comprises a tissue web having a basis weight of less than about 50 gsm and wherein the viscous composition comprises a polysiloxane, said tissue web after being treated with the composition having a wet:dry ratio of at least 0.50.

26. A paper product as defined in claim 14, wherein the topical viscous composition is a solid at ambient temperatures.

* * * * *